US005533627A

United States Patent [19]

Nordqvist

[11] Patent Number: 5,533,627

[45] Date of Patent: Jul. 9, 1996

[54] DEVICE FOR FEEDING AND STORING VALUABLE DOCUMENTS

[75] Inventor: Leif Nordqvist, Åkersberga, Sweden

[73] Assignee: Cash Guard AB, Stockholm, Sweden

[21] Appl. No.: 244,224

[22] PCT Filed: Nov. 10, 1992

[86] PCT No.: PCT/SE92/00773

§ 371 Date: Sep. 13, 1994

§ 102(e) Date: Sep. 13, 1994

[87] PCT Pub. No.: WO93/10511

PCT Pub. Date: May 27, 1993

[30] Foreign Application Priority Data

Nov. 21, 1991 [SE] Sweden ..... 9103447

[51] Int. Cl.[6] ..... B07C 5/00

[52] U.S. Cl. ..... 209/534; 194/207

[58] Field of Search ..... 194/206, 207; 209/534, 551

[56] References Cited

U.S. PATENT DOCUMENTS

| | | | |
|---|---|---|---|
| 3,038,157 | 6/1962 | Simjian . | |
| 3,440,606 | 4/1969 | Bayha | 194/207 |
| 4,337,864 | 7/1982 | McLean . | |
| 5,301,786 | 4/1994 | Yoshihara | 194/207 |

FOREIGN PATENT DOCUMENTS

| | | | |
|---|---|---|---|
| 0409809 | 1/1991 | European Pat. Off. . | |
| 1944134 | 11/1979 | Germany | 194/207 |
| 0060190 | 5/1977 | Japan | 194/207 |
| 210179 | 1/1967 | Switzerland . | |
| 0483069 | 1/1970 | Switzerland | 194/207 |
| 661603 | 7/1987 | Switzerland | 194/207 |

*Primary Examiner*—D. Glenn Dayoan
*Attorney, Agent, or Firm*—Larson and Taylor

[57] ABSTRACT

A device for sorting, storing and paying out of valuable documents, and particularly bank notes, which is capable of handling paying-in and paying-out in a single apparatus. The device uses continuous film means to enclose the document and to transport the document about a collecting spool. By use of a detecting device and a verification device, the documents are verified and stored in order prior to a subsequent pay-out if verified or return to the submitter if unverified.

6 Claims, 1 Drawing Sheet

DEVICE FOR FEEDING AND STORING VALUABLE DOCUMENTS

BACKGROUND OF THE INVENTION

1. Field of the Invention

The invention relates to a device for sorting, storing and laying out valuable documents and more particularly for sorting and paying out bank notes.

2. Description of the Related Art

The problem with these devices is that they have difficulty in handling notes in an inferior condition and that they require two separate systems for paying-in and paying-out, this being due to the fact that storage takes place in an unsorted order in the case of the feed-in device, whereas the paying-out unit requires the notes to be present in ordered bundles to enable the correct number of notes to be paid out. Document readers/note readers are principally designed to function in respect of unmanned applications in which great accuracy is required in order to check the genuineness of the note. A major deficiency is that current systems for paying-out do not readily handle notes of uneven quality, which situation naturally occurs when notes are received from customers. Nor is there any known technique for catering within a single unit for both the receipt and paying-out of notes, which would mean that the paying-in till and the paying-out till would have to be separated if the above-named units were to be used.

SUMMARY OF THE INVENTION

As an example of the abovementioned, reference can be made to a device according to U.S. Pat. No. 4,337,864, which comprises a loading unit 12 and a feed-out unit 10, 14. A system of this kind is therefore not designed for manual feed-in and not, above all, for alternating manual feed-out and feed-in, which means that the system is inflexible.

The object of the invention is to solve the above problems and, with a single device, to feed in, store and pay out notes regardless of their physical condition. The invention constitutes a solution to the problems.

In particular, the present invention is a device for sorting valuable documents including bank notes in a cash-register system. This device is capable of handling paying-in and paying-out documents, in a single apparatus, by enclosing the documents between two continuous films which are wound around a spool in a consecutive order. With suitable circuitry means and detecting means, the documents can be verified and stored in order between the films so as to be later paid out upon a suitable command or returned to the submitter if not verified when paid in.

The device is for use primarily with manual operated cash register counters in which an installation of the described device is normally used to verify and store verified documents so they can be accounted for in the system.

DESCRIPTION OF THE PREFERRED EMBODIMENTS

Figure 1:
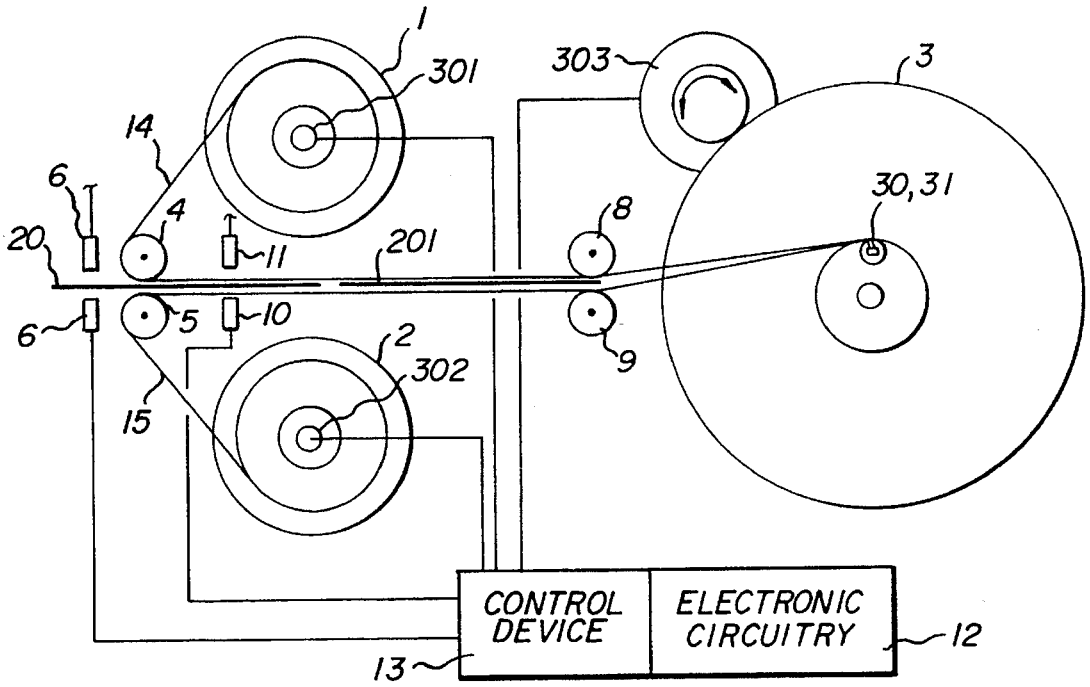
FIG. 1 is a schematic elevation view of the present invention.

According to FIG. 1, the self-enclosed note-handling function contains three collecting spools per note type 1, 2, 3, two of which spools 1, 2 are connected to the note intake. These two spools 1, 2 each have their film 14, 15 of desired length, preferably in transparent material, initially predominantly wound up.

The loose ends of the film from each respective spool are fitted close to the centre upon the third spool 3, at the same fixing point 30, 31. At each spool there is fitted an electrically controlled motor for controlling the direction of rotation of the respective spool. Four control elements, preferably in the form of mounted rollers 4, 5, 8, 9, are fitted between the two film spools 1, 2 and the third collecting spool 3, these control elements having the task of pressing the films against each other with the note in-between. The feed-in part also has necessary recesses for detection devices 6, 10, 11. A front detection device 6 detects the existence of a note in the feed-in or feed-out opening. Further in, between the first 4, 5 and the second film-control elements 8, 9, there is disposed a second set of detection devices 10, 11, which measure the size of the note, detect the number of notes and, if required, a transillumination is carried out to check that the note is genuine.

When a note 201 is fed in, this is detected at the note intake 6 and the electrically controlled motors start up, via the control device 13, at each respective spool. The motors are electronically synchronised with each other in order to keep the films 14, 15 under constant tension. By virtue of the motors rotating the spools so that the film begins to be wound around the spool 3, the film from spool 1 and spool 2 is pressed together by the control elements 4, 5, 8, 9. A note which is introduced through the note intake is pressed between the films 14, 15 and is detected by a transilluminating detector 10 and a receiver 11, by which the size, value and genuineness of the note are determined. If the note is approved, the control device 13 stops the motors of the spools until the next note 20 is fed in. Upon the approval of the note, a computing-up figure is also given to the microprocessor-controlled electronic circuitry 12, which mathematically computes and stores the correct value in its internal memory circuits. If, on the other hand, the note is not approved, the control device 13 reverses the motors so that the note is fed out again via the note intake and the electronic circuitry does not store this value as a feed-in.

In the case of the paying-out or feed-out of notes, the control device 13 reverses the motors, so that the desired number of notes can be obtained; in other words the note which was last fed-in comes out first, since the notes are stored in consecutive sequence around the collecting spool 3. When the invention pays out (reverses), the films 14, 15 are guided back to the collecting spools 1,2 at the same time as the spool 3 is being emptied. The design of the invention means that notes cannot get caught or wind themselves around mechanical parts since they are stored enclosed between the films 14, 15 and in consecutive order one behind the other. Each note is also detected via detectors 10, 11 as it is being fed out, so that the electronic circuitry 12 obtains a computing-down figure for each pay-out, which is deducted from the stored value in the memory circuits. This means that a complete check of the accumulated value around the spool 3 is always obtainable.

A casing unit (not shown) encloses all the abovenamed components incorporated in the device, apart from possibly the electronic unit 12 and/or the control device 13.

Figure 2:
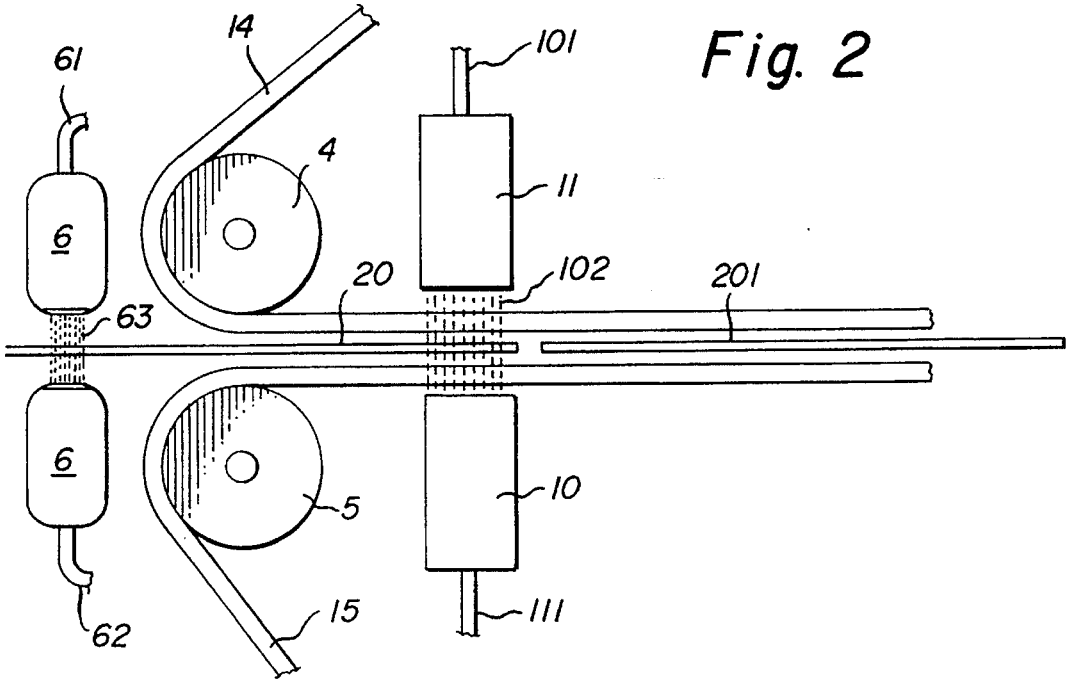
FIG. 2 is a close-up schematic diagram of the detection and verification means of the present invention depicted in FIG. 1.

FIG. 2 shows a more detailed view of the position of the films 14, 15 in relation to notes 20, 201, together with control elements 4, 5 and detectors 10, 11 for checking the size, value and genuineness of the note. In order to detect when a note is required to be fed in, an electronic detection device 6 is fitted at the feed-in and feed-out part of the invention. This detection device 6 comprises a transmitter part and a receiver part which are connected to the control device 13 via connecting cables 61, 62. The transmission and receiver parts operate with a light barrier 63 such that if the light beam is broken by a note, for example, a signal is given to the control device 13, which in turn starts the motors 301, 302, 303 so that the note can be received and stored between the films 14, 15.

The inner detection devices 10, 11 have the task of determining the size and genuineness of the note and operate on the transillumination principle, similarly to the feed-in detector 6, with the difference that the receiving device 11 has a linear output signal to the electronic circuitry. These detection devices 10, 11 are connected to the microprocessor-controlled electronic circuitry 12 via connecting devices 101, 111. The electronic circuitry part 12, by comparing the feed-in speed of the note and the time for which the transilluminating detectors 10, 11 are activated by the note, is able to determine the size of the note and hence also whether the correct type of note has been fed in. If the note is not accepted, an opportunity is given to reverse the system so that the note is fed back out again.

The detection devices 10, 11 additionally have the task, by measuring the transillumination force in the note during the time in which it is passing the detectors 10, 11, of determining whether the note is genuine or false. If the note is illuminated with a plurality of colours, or by colour-filtering the lens of the receiver device, a measure can also be taken of the transillumination per colour. By virtue of the electronic unit 12 being able to "learn" how a pattern from a reference note activates the transillumination force at detectors 10, 11 and being able to store these measurement values in an electronic memory, it is possible, by making a comparison between this reference value and the value of the fed-in note in question, to determine whether the note is genuine or false. A non-accepted note is thus fed back out again by the system being reversed.

The invention is not limited to what has been shown in the figures but can be modified within the framework of the patent claims. Thus, for example, the spools 1, 2, which collect a single-film 14 or 15 respectively, can be placed where required inside the device, for example behind the spool 3 which collects the double films 14+15. It is clear that detector elements other than those described under 6, 10, 11 can be used, for example detectors for infra-red, ultra-violet or some other invisible light. Moreover, instead of an electronic detection device 6, use can be made of a detection device in the form of a manually activatable circuit breaker.

I claim:

1. A device used in a cash-register system for handling documents of a same value comprising:

an opening which is used for feeding in and feeding out of documents;

two single film collecting spools about which an associated continuous film is respectively wound and unwound, said continuous films coming together adjacent said opening;

a double film collecting spool whereby documents fed in between said continuous films at said opening are (a) stored in consecutive order between said continuous films by being wound around said double film collecting spool when said single film collecting spools and said double film collecting spool are operated in a feed in direction, and (b) fed out in reverse order at the opening from between said continuous films by unwinding of said double film collecting spool when said single film collecting spools and said double film collecting spool are operated in a feed out direction;

a motor means for selectively operating said single film collecting spools and said double film collecting spool in the feed in and feed out directions;

a first detection means located adjacent said opening for detecting the presence of a document fed in at said opening and fed out at said opening;

a second detection means for checking each document fed in between said continuous films and for causing a fed in document to be fed out where that document fails to meet a check, said second detection means being located between said first detection means and said double film collecting spool;

a control means connected to said motor means and said first detection means for controlling a feeding out of a desired number of the documents located between said continuous films; and a circuitry means connected to said first detecting means for computing a new total of documents in the device after each feed in and feed out of documents.

2. The device as claimed claim 1 wherein said second detection means uses light in a transillumination checking of the document, and said films are transilluminated by the light.

3. The device as claimed in claim 1 wherein said continuous films are pressed together with a fed in document therebetween adjacent said opening, and wherein said second detection means is located where the document and said continuous films are pressed together.

4. The device as claimed in claim 1 wherein said second detection means is activated by the presence of a document passing thereby; and wherein said circuitry means (a) compares a feed-in speed of the continuous films caused by said motor means and a time period for which said second detection means is activated by the passage of the document, (b) determines a size of the document passing by the second detection means, (c) determines if the document size is correct, and (d) causes the motor means to return the document to the opening if the determined size is not correct for the value of document to be handled by the device.

5. The device as claimed in 1 wherein said motor means includes respective reversible electric motors which respectively drive each of said single film collecting spools and said double film collecting spool.

6. The device as claimed in 1 wherein said continuous films are made of a transparent material.

* * * * *